US011584981B2

(12) United States Patent
Mitsunobu et al.

(10) Patent No.: US 11,584,981 B2
(45) Date of Patent: Feb. 21, 2023

(54) PLATED STEEL SHEET

(71) Applicant: NIPPON STEEL CORPORATION, Tokyo (JP)

(72) Inventors: Takuya Mitsunobu, Tokyo (JP); Jun Maki, Tokyo (JP); Hiroshi Takebayashi, Tokyo (JP); Takehiro Takahashi, Tokyo (JP); Kohei Tokuda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/421,954

(22) PCT Filed: Apr. 16, 2020

(86) PCT No.: PCT/JP2020/016755
§ 371 (c)(1),
(2) Date: Jul. 9, 2021

(87) PCT Pub. No.: WO2020/213687
PCT Pub. Date: Oct. 22, 2020

(65) Prior Publication Data

US 2022/0112589 A1 Apr. 14, 2022

(30) Foreign Application Priority Data

Apr. 19, 2019 (JP) ..... JP2019-080287

(51) Int. Cl.
*C22C 18/04* (2006.01)
*C23C 2/06* (2006.01)
(Continued)

(52) U.S. Cl.
CPC ..... *C23C 2/06* (2013.01); *C22C 18/04* (2013.01); *C22C 21/00* (2013.01); *C23C 2/28* (2013.01); *C23C 2/40* (2013.01)

(58) Field of Classification Search
None
See application file for complete search history.

(56) References Cited

U.S. PATENT DOCUMENTS 6,465,114 B1 10/2002 Honda et al.
2020/0002798 A1 1/2020 Tokuda et al.
(Continued)

FOREIGN PATENT DOCUMENTS

JP 2001-329383 A 11/2001
JP 2002-285311 A 10/2002
(Continued)

*Primary Examiner* — Daniel J. Schleis
(74) *Attorney, Agent, or Firm* — Birch, Stewart, Kolasch & Birch, LLP

(57) ABSTRACT

A plated steel sheet having excellent post-coating corrosion resistance includes: a steel; and a plating layer that is provided on a surface of the steel, in which the plating layer includes, by mass %, Al: 5.00% to 35.00%, Mg: 2.50% to 13.00%, Fe: 5.00% to 35.00%, Si: 0% to 2.00%, Ca: 0% to 2.00%, and a remainder consisting of Zn and impurities, and in a cross section of the plating layer, the area fraction of a $Fe_2Al_5$ phase is 5.0% to 60.0%, the area fraction of an eutectic structure of Zn and $MgZn_2$ is 10.0% to 80.0%, the area fraction of a massive $MgZn_2$ phase is 5.0% to 40.0%, and the area fraction of a remainder is 10.0% or less.

20 Claims, 1 Drawing Sheet

(51) Int. Cl.

| | |
|---|---|
| ***C22C 21/00*** | (2006.01) |
| ***C23C 2/28*** | (2006.01) |
| ***C23C 2/40*** | (2006.01) |

(56) References Cited

U.S. PATENT DOCUMENTS

| | | | |
|---|---|---|---|
| 2020/0017937 | A1 | 1/2020 | Mitsunobu |
| 2021/0039354 | A1 | 2/2021 | Tokuda et al. |

FOREIGN PATENT DOCUMENTS

| | | | | |
|---|---|---|---|---|
| JP | 2002-302749 | A | | 10/2002 |
| JP | 2003-253416 | A | | 9/2003 |
| JP | 2009-120947 | A | | 6/2009 |
| JP | 2009120947 | A | * | 6/2009 |
| JP | 2010-70810 | A | | 4/2010 |
| JP | 2015-214749 | A | | 12/2015 |
| WO | WO 00/71773 | A1 | | 11/2000 |
| WO | WO 2018/139620 | A1 | | 8/2018 |
| WO | WO 2018/169085 | A1 | | 9/2018 |
| WO | WO 2019/180852 | A1 | | 9/2019 |

* cited by examiner

PLATED STEEL SHEET

TECHNICAL FIELD OF THE INVENTION

The present invention relates to a plated steel sheet.

Priority is claimed on Japanese Patent Application No. 2019-080287, filed on Apr. 19, 2019, the content of which is incorporated herein by reference.

RELATED ART

Recently, as a vehicle structural member, a plated steel sheet is used from the viewpoint of corrosion resistance, and a galvannealed steel sheet is mainly used in the Japanese market. The galvannealed steel sheet is a plated steel sheet in which weldability and post-coating corrosion resistance are improved by performing an alloying heat treatment on a steel sheet after hot-dip galvanizing and diffusing Fe from the steel sheet (base steel sheet) into a plating layer. For example, a plated steel sheet disclosed in Patent Document 1 is representatively used as a plated steel sheet for a vehicle in Japan.

Examples of a method of improving corrosion resistance of plating include addition of Al to Zn. In the building material field, as a high corrosion-resistant steel sheet, a hot-dip Al—Zn alloy plated steel sheet has been widely put into practice. A plating layer of the hot-dip Al—Zn alloy plated steel sheet is formed of: a dendritic α-(Zn,Al) phase that is initially crystallized from a molten state (Al primary phase: α-(Zn,Al) phase crystallized as a primary phase in the Al—Zn binary phase diagram or the like; this phase is not necessarily an Al-rich phase and is crystallized as a solid solution of Zn and Al); and a structure (Zn/Al mixed phase structure) formed of a Zn phase and an Al primary crystal phase that is formed in a gap of the dendritic Al primary phase. The Al primary phase is passivated, and the Zn/Al mixed phase structure has a higher Zn concentration than the Al primary phase. Therefore, corrosion concentrates on the Zn/Al mixed phase structure. As a result, the corrosion propagates in a worm-eaten state in the Zn/Al mixed phase structure, and a corrosion propagation path is complicated. Therefore, the corrosion is not likely to easily reach the base material steel sheet. As a result, the hot-dip Al—Zn alloy plated steel sheet has higher corrosion resistance than a hot-dip galvanized steel sheet where a plating layer has the same thickness.

When this hot-dip Al—Zn alloy plated steel sheet is used as a vehicle exterior panel, the plated steel sheet is provided to automobile manufacturers in a state where it is plated in a continuous hot-dip plating facility, is processed into a panel component shape, and subsequently undergoes automotive general coating of chemical conversion treatment, further electrodeposition coating, intermediate coating, and top coating. However, in the exterior panel formed of the hot-dip Al—Zn alloy plated steel sheet, when a coating film is damaged, due to the unique plating phase structure formed of the two phases including the Al primary phase and the Zn/Al mixed phase structure, preferential dissolution of Zn (selective corrosion of the Zn/Al mixed phase structure) initiates from a damaged part at an interface between the coating film and the plating. It is known that this corrosion propagates deep into a coating defect-free part, severe coating blistering occurs, and thus there is a problem in that sufficient corrosion resistance (post-coating corrosion resistance) cannot be secured.

In order to improve corrosion resistance, addition of Mg to the Al—Zn plating is also considered. For example, Patent Documents 2 and 3 disclose a plated steel sheet in which corrosion resistance is improved by adding Mg to a plating composition to form a $Zn/Al/MgZn_2$ ternary eutectic structure containing a Mg compound such as $MgZn_2$ in a plating layer. However, it is presumed that, in the hot-dip Al—Zn alloy plated steel sheet disclosed in Patent Document 2, an Al primary phase including a passivation film is still formed, and it is presumed that the problem of corrosion resistance caused when the coating film is damaged after coating (post-coating corrosion resistance) is not solved.

In addition, Patent Document 4 discloses a hot-dip Al—Zn alloy plated steel sheet in which post-coating corrosion resistance is improved by adding Bi to fracture passivation of an Al primary phase. However, it is presumed that an Al primary phase in a plating layer formed in a defined manufacturing process still has a more electromotive potential than a $Zn/Al/MgZn_2$ ternary eutectic structure around the Al primary phase, and it is presumed that the post-coating corrosion resistance does not satisfy the level of a plated steel sheet for a vehicle. Further, the addition of Bi may lead to deterioration in chemical convertibility and an increase in manufacturing cost.

In addition, Patent Document 5 discloses a technique of adding Mg to an Al—Zn-based plating layer in order to provide zinc-based alloy-plated steel having excellent corrosion resistance and weldability. However, in this technique, a large amount of a Fe—Zn phase that deteriorates post-coating corrosion resistance is formed in the plating layer.

Under these circumstances, it is desired to develop a plated steel sheet having excellent post-coating corrosion resistance that is suitable for a vehicle.

PRIOR ART DOCUMENT

Patent Document

[Patent Document 1] Japanese Unexamined Patent Application, First Publication No. 2003-253416

[Patent Document 2] PCT International Publication No. WO2000/71773

[Patent Document 3] Japanese Unexamined Patent Application, First Publication No. 2001-329383

[Patent Document 4] Japanese Unexamined Patent Application, First Publication No. 2015-214749

[Patent Document 5] Japanese Unexamined Patent Application, First Publication No. 2009-120947

DISCLOSURE OF THE INVENTION

Problems to be Solved by the Invention

The present invention has been made in consideration of the above-described circumstances, and an object thereof is to provide a plated steel sheet having excellent post-coating corrosion resistance.

Means for Solving the Problem

In order to achieve the object, the present invention adopts the following configurations.

That is, a plated steel sheet according to an aspect of the present invention includes: a steel; and a plating layer that is provided on a surface of the steel, in which the plating layer includes, by mass %, Al: 5.00% to 35.00%, Mg: 2.50% to 13.00%, Fe: 5.00% to 35.00%, Si: 0% to 2.00%, Ca: 0% to 2.00%, and a remainder consisting of Zn and impurities, and in a cross section of the plating layer, the area fraction of a $Fe_2Al_5$ phase is 5.0% to 60.0%, the area fraction of an eutectic structure of Zn and $MgZn_2$ is 10.0% to 80.0%, the area fraction of a massive $MgZn_2$ phase is 5.0% to 40.0%, and the area fraction of a remainder is 10.0% or less.

Here, the plating layer may include, by mass %, Al: 10.00% to 30.00%.

Here, the plating layer may include, by mass %, Mg: 3.00% to 11.00%.

Here, the plating layer may include, by mass %, Mg: 4.00% or more.

In addition, the plating layer may include, by mass %, Ca: 0.03% to 1.0%.

In addition, in the cross section of the plating layer, the area fraction of a $Fe_2Al_5$ phase may be 20.0% to 60.0%.

In addition in the cross section of the plating layer, the area fraction of an Al—Zn dendrite mainly formed of an Al primary crystal phase and a Zn phase may be 5.0% or less.

In addition, in the cross section of the plating layer, the area fraction of a Zn/Al/$MgZn_2$ ternary eutectic structure may be 5.0% or less.

In addition, in the cross section of the plating layer, the area fraction of a massive Zn phase may be 5.0% or less.

In addition, in the cross section of the plating layer, the area fraction of a $Mg_2Si$ phase may be 5.0% or less.

Effects of the Invention

According to the aspect of the present invention, a plated steel sheet having excellent post-coating corrosion resistance can be provided.

EMBODIMENTS OF THE INVENTION

Figure 1:
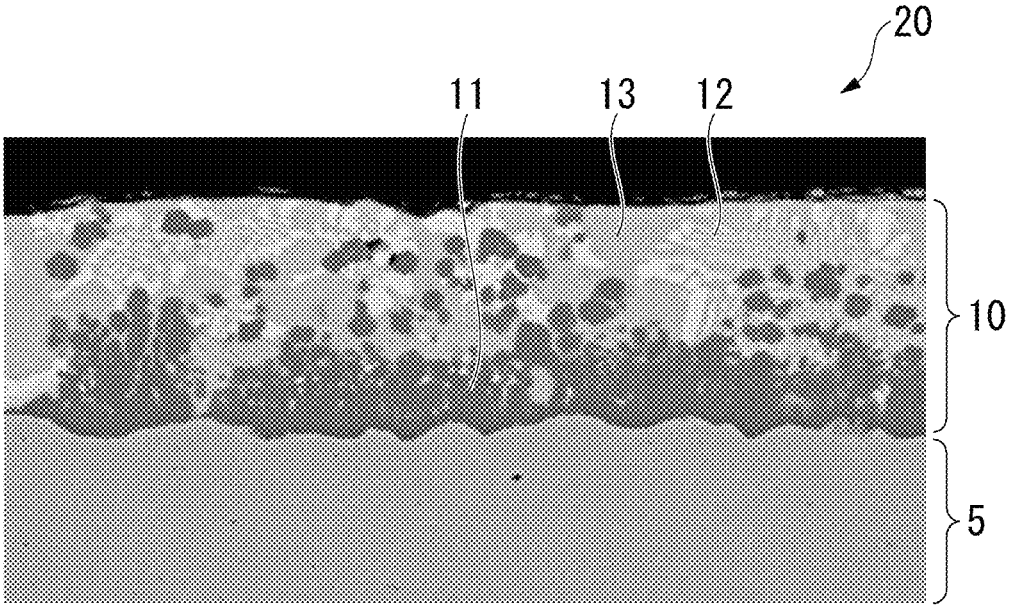
FIG. 1 is a SEM image showing a structure of a plated steel sheet according to an embodiment.

Hereinafter, a plated steel sheet according to an embodiment having excellent post-coating corrosion resistance and a method of manufacturing the same will be described. In the embodiment, a numerical range represented using "to" refers to a range including numerical values before and after "to" as a lower limit and an upper limit.

[Plated Steel Sheet]

The plated steel sheet according to the embodiment includes: a steel; and a plating layer that is provided on a surface of the steel, in which the plating layer includes, by mass %, Al: 5.00% to 35.00%, Mg: 2.50% to 13.00%, Fe: 5.00% to 35.00%, Si: 0% to 2.00%, Ca: 0% to 2.00%, and a remainder consisting of Zn and impurities, and in a cross section of the plating layer, the area fraction of a $Fe_2Al_5$ phase is 5.0% to 60.0%, the area fraction of an eutectic structure of Zn and $MgZn_2$ is 10.0% to 80.0%, the area fraction of a massive $MgZn_2$ phase is 5.0% to 40.0%, and the area fraction of a remainder is 10.0% or less. That is, in the embodiment, the post-coating corrosion resistance of the plated steel sheet is improved by actively forming the $Fe_2Al_5$ phase, the eutectic structure of Zn and $MgZn_2$, and the $MgZn_2$ phase having excellent post-coating corrosion resistance in the plating layer and suppressing the formation of a phase that deteriorates post-coating corrosion resistance, for example, an Al—Zn dendrite or a Fe—Zn phase. Further, the plated steel sheet according to the embodiment includes a large amount of the $Fe_2Al_5$ phase. Therefore, liquid metal embrittlement (LME) during spot welding can also be suitably prevented (excellent LME resistance can be obtained).

<Steel>

The material of the steel (base steel sheet) as a base material of the plated steel sheet is not particularly limited. General steel, Ni-precoated steel, Al-killed steel, or some high alloy steel can be used. The shape of the steel is also not particularly limited.

<Plating Layer>

The plated steel sheet according to the embodiment having excellent post-coating corrosion resistance includes a plating layer that is formed on a surface of the steel.

(Chemical Composition)

Next, a chemical composition of the plating layer will be described. In the following description, unless specified otherwise, "%" represents "mass %".

Al: 5.00% to 35.00%

Al is an element that is necessary to contain an element other than Zn in the plating layer. Originally, in a Zn plating layer (Zn layer), another element is not likely to be contained, for example, a high concentration of Mg cannot be added. However, by containing Al in the plating layer (Zn-based plating layer), a plating layer containing Mg can be manufactured. Further, Fe dispersed in the plating layer in the alloying process reacts (is alloyed) with Al prior to Zn such that a $Fe_2Al_5$ phase having excellent post-coating corrosion resistance and LME resistance can be formed. Further, the formation of a Fe—Zn phase that deteriorates post-coating corrosion resistance in the alloying process can be suppressed. In order to suppress the formation of the Fe—Zn phase, Mg addition is also effective, and this effect is exhibited particularly when the Mg concentration is 2.50% or more. The Mg concentration is more preferably 4.00% Of more.

When the Al concentration is less than 5.00%, inclusion of Mg and an alloying element imparting performance to the plating layer tends to be difficult. In addition, Al has a low density, and thus a larger amount of an Al primary crystal phase in terms of mass content is formed as compared to Zn. However, when the Al concentration is less than 5.00%, most part of the plating layer tends to be a Zn phase. As a result, post-coating corrosion resistance also deteriorates significantly. It is not preferable that the Zn phase is the first phase in the plating layer from the viewpoint of post-coating corrosion resistance.

In addition, when the Al concentration is less than 5.00%, the $MgZn_2$ phase having poor plastic deformability is the primary phase in the plating layer and thus is likely to grow coarsely. As a result, the workability of the plating layer tends to deteriorate significantly.

In addition, when the Al concentration is less than 5.00%, the $Fe_2Al_5$ phase cannot be sufficiently formed in the alloying process.

Accordingly, the Al concentration is 5.00% or higher and preferably 10.00% or higher.

On the other hand, when the Al concentration increases excessively, the proportion of the Al primary crystal phase in the plating layer increases rapidly, and the proportion of a Zn/$MgZn_2$ binary eutectic structure necessary to impart post-coating corrosion resistance decreases, which is not preferable. Therefore, the Al concentration is 35.00% or less and preferably 30.00% or less.

This way, in the embodiment, by balancing the Al concentration and a Fe concentration described below (adjusting the concentrations to be in predetermined concentration ranges), Al reacts actively with Fe to form a $Fe_2Al_5$ phase. Accordingly, in the embodiment, by causing Al to be mainly present as the Fe—Al primary crystal phase in the plating layer, the amount of Al present as the Al primary crystal phase can be reduced. As a result, the amount of dendrite mainly formed of an Al primary crystal phase and a Zn phase that causes deterioration in corrosion resistance can be reduced.

Mg: 2.50% to 13.00%

Mg is an element that is necessary to impart post-coating corrosion resistance. When Mg is added to a Zn-based plating layer, Mg forms $MgZn_2$ as an intermetallic compound. Further, Mg also has a characteristic in that the formation of the Fe—Zn phase is suppressed. The Mg concentration is the minimum necessary to sufficiently improve the post-coating corrosion resistance of the plating layer and to suppress the formation of the Fe—Zn phase is 2.50%. Therefore, the Mg concentration is 2.50% or more, preferably 3.00% or more, and more preferably 4.00% or more.

On the other hand, when the Mg concentration is more than 13.00%, the amount of the $MgZn_2$ phase rapidly increases, the plastic deformability of the plating layer is lost, and the workability deteriorates, which is not preferable. Accordingly, the Mg concentration is 13.00% or less and preferably 11.00% or less.

This way, in the embodiment, by adding predetermined amounts of Al and Mg to the plating layer, the formation of the Fe—Zn phase is suppressed. Therefore, in the embodiment, the Fe—Zn phase is not substantially present in the plating layer. In particular, the Fe—Zn phase deteriorates the post-coating corrosion resistance and, when the coating surface is damaged, is likely to cause red rust to occur. Therefore, it is preferable that the formation of the Fe—Zn phase is suppressed as far as possible. Examples of the type of the Fe—Zn phase include γ phase, δ phase, and ζ phase. In order to suppress the formation of the Fe—Zn phase, it is necessary that the chemical composition of the plating layer is adjusted to the composition according to the embodiment (in particular, the Al concentration and the Mg concentration are important) and the alloying temperature is 440° C. to 480° C.

Fe: 5.00% to 35.00%

When the Fe concentration is less than 5.00%, the Fe content is insufficient, and the amount of the $Fe_2Al_5$ phase is small, which is not preferable. In addition, when the Fe concentration is less than 5.00%, the area ratio of the Al—Zn dendrite not contributing to the improvement of the post-coating corrosion resistance may be more than 5%, which is not preferable. Therefore, the Fe concentration is 5.00% or more, preferably 10.00% or more, and more preferably 15.00% or more.

When the Fe concentration is more than 35.00%, a desired metallographic structure may not be formed in the plating layer according to the embodiment. As the amount of the Fe component increases, the potential increases, appropriate sacrificial protection ability for the steel cannot be maintained, and the corrosion rate may increase, which is not preferable. Therefore, the Fe concentration is 35.00% or less, preferably 30.00% or less, and more preferably 25.00% or less.

In addition, regarding the Fe concentration relative to the Al concentration, Fe/Al is preferably 0.9 to 1.2. By adjusting Fe/Al to be in the above-described range, the $Fe_2Al_5$ phase is likely to be formed.

When Fe/Al is less than 0.9, it is difficult to form a sufficient amount of the $Fe_2Al_5$ phase, and thus an excess amount of the dendrite formed of the Al primary crystal phase and the Zn phase is formed.

In addition, when Fe/Al is more than 1.2, a Fe—Zn-based intermetallic compound phase is likely to be formed. Even in this case, the $Fe_2Al_5$ phase is not likely to be formed.

Si: 0% to 2.00%

Si is an element that is effective for improving adhesion between the steel and the plating layer. Therefore, Si may be contained in the plating layer. Si is not necessarily contained in the plating layer. Therefore, the lower limit of the Si concentration is 0%. The adhesion improvement effect by Si is exhibited when the Si concentration in the plating layer is 0.03% or more. Therefore, when Si is contained in the plating layer, the Si concentration is preferably 0.03% or more.

On the other hand, even when the Si concentration in the plating layer is more than 2.00%, the adhesion improvement effect by Si is saturated. Therefore, even when Si is contained in the plating layer, the Si concentration is set to be 2.00% or less. The Si concentration is preferably 1.00% or less.

Ca: 0% to 2.00%

Ca is an element that is effective for improving the post-coating corrosion resistance of the plated steel sheet. Therefore, Ca may be contained in the plating layer. Ca is not necessarily contained in the plating layer. Therefore, the lower limit of the Ca concentration is 0%. The post-coating corrosion resistance improvement effect by Ca is exhibited when the Ca concentration in the plating layer is 0.03% or more. Therefore, when Ca is contained in the plating layer, the Ca concentration is preferably 0.03% or more.

On the other hand, even when the Ca concentration in the plating layer is more than 2.00%, the post-coating corrosion resistance improvement effect by Ca is saturated. Therefore, even when Ca is contained in the plating layer, the Ca concentration is set to be 2.00% or less. The Ca concentration is preferably 1.00% or less.

Remainder: Zn and Impurities

The remainder other than Al, Mg, Fe, Si, and Ca consists of Zn and impurities. Here, the impurities refer to elements that are unavoidably incorporated in the process of plating, and the total amount of the impurities may be about 3.00%. That is, the amount of the impurities in the plating layer may be 3.00% or less.

Examples of elements that may be contained as the impurities and the concentrations of the elements include Sb: 0% to 0.50%, Pb: 0% to 0.50%, Cu: 0% to 1.00%, Sn: 0% to 1.00%, Ti: 0% to 1.00%, Sr: 0% to 0.50%, Ni: 0% to 1.00%, and Mn: 0% to 1.00%. When the impurity elements having concentrations higher than the above-described ranges are contained in the plating layer, it is difficult to obtain the desired characteristics, which is not preferable.

The chemical composition of the plating layer can be measured, for example, using the following method. First, an acid solution is obtained by peeling and dissolving the plating layer with an acid containing an inhibitor that suppresses the corrosion of the base metal (steel). Next, by measuring the obtained acid solution by ICP analysis, the chemical composition (the kinds and contents of the chemical components) of the plating layer can be obtained. The kind of the acid is not particularly limited as long as it is an acid that can dissolve the plating layer. In this measurement method, the chemical composition is measured as the average chemical composition of the entire plating layer as a target to be measured. In Examples described below, the chemical components (chemical composition) of the plating layer were measured using this method.

(Structure)

In a cross section (cross section parallel to a thickness direction) of the plating layer according to the embodiment, the area fraction of a $Fe_2Al_5$ phase is 5.0% to 60.0%, the area fraction of a eutectic structure of Zn and $MgZn_2$ is 10.0% to 80.0%, the area fraction of a massive $MgZn_2$ phase is 5.0% to 40.0%, and the area fraction of a remainder is 10.0% or less.

FIG. 1 is a SEM image showing a structure of a plated steel sheet 20 according to the embodiment. As shown in FIG. 1, when a cross section of the plated steel sheet 20 according to the embodiment is observed with a SEM, a hot-dip Zn—Al—Mg-based plating layer 10 is formed on a surface of a steel 5. A $Fe_2Al_5$ phase 11, a massive $MgZn_2$ phase 12, and a Zn/$MgZn_2$ binary eutectic structure 13 are observed in the plating layer 10.

Figure 2:
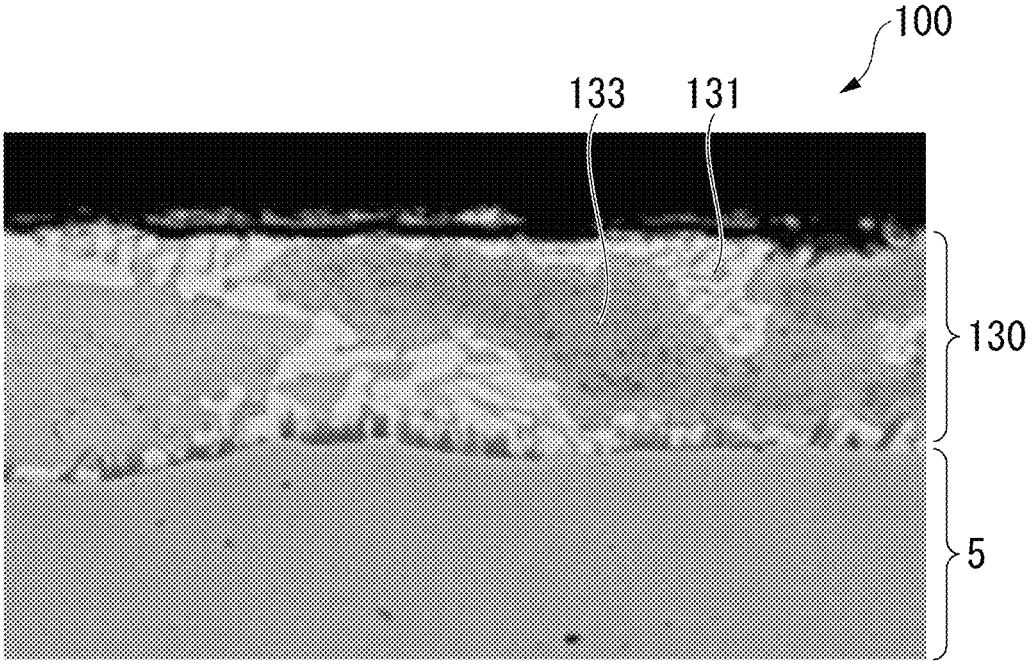
FIG. 2 is a SEM image showing a structure of a plated steel sheet in the related art.

FIG. 2 is a SEM image showing a structure of a plated steel sheet 100 in the related art. The plated steel sheet 100 in the related art shown in FIG. 2 is a hot-dip Zn—Al—Mg-based plated steel sheet in the related art, and by performing hot-dip Zn—Al—Mg-based plating on the steel 5, a hot-dip Zn—Al—Mg-based plating layer 130 is formed on a surface of the steel 5.

As shown in FIG. 2, the alloying process is not performed on the hot-dip Zn—Al—Mg-based plating layer 130 of the plated steel sheet 100 in the related art. Therefore, a Zn/Al/$MgZn_2$ ternary eutectic structure 131 or an (Al—Zn) dendrite 133 accounts for most part of the hot-dip Zn—Al—Mg-based plating layer 130, and the $Fe_2Al_5$ phase, the massive $MgZn_2$ phase, or the Zn/$MgZn_2$ binary eutectic structure is not observed.

Hereinafter, the structure of the plating layer according to the embodiment will be described.

Area Fraction of $Fe_2Al_5$ Phase: 5.0% to 60.0%

In the plated steel sheet according to the embodiment, by performing an alloying process after a hot-dip plating process described below, the $Fe_2Al_5$ phase is formed in the plating layer. The plating layer according to the embodiment contains 5% or more of the $Fe_2Al_5$ phase such that suitable post-coating corrosion resistance can be obtained. Therefore, the area fraction of the $Fe_2Al_5$ phase in the plating layer is 5.0% or more and preferably 20.0% or more.

On the other hand, when the area fraction of the $Fe_2Al_5$ phase in the plating layer is more than 60.0%, the post-coating corrosion resistance improvement effect relative to blister width is saturated, $Fe_2Al_5$ is corroded in a corrosive environment due to inclusion of Fe, and thus red rust is likely to occur, which is not preferable. Therefore, the area fraction of the $Fe_2Al_5$ phase is 60.0% or less and preferably 50.0% or less.

The $Fe_2Al_5$ phase an important structure from the viewpoint of obtaining post-coating corrosion resistance and suitably preventing liquid metal embrittlement (LME) during spot welding (obtaining excellent LME resistance).

Area Fraction of Zn/$MgZn_2$ Binary Eutectic Structure: 10.0% to 80.0%

The Zn/$MgZn_2$ binary eutectic structure is a binary eutectic structure of a Zn phase and a $MgZn_2$ phase that is an intermetallic compound. When the area fraction of the Zn/$MgZn_2$ binary eutectic structure is 10.0% or more, suitable post-coating corrosion resistance can be obtained. Therefore, when the area fraction of the Zn/$MgZn_2$ binary eutectic structure is 10% or more and preferably 20.0% or more.

On the other hand, when the area fraction of the Zn/$MgZn_2$ binary eutectic structure is more than 80.0%, the post-coating corrosion resistance improvement effect is saturated, the area ratio of the $Fe_2Al_5$ phase having the LME suppressing effect relatively decreases, and LME resistance cannot be secured, which is not preferable. Therefore, the area fraction of the Zn/$MgZn_2$ binary eutectic structure is 80.0% or less and preferably 70.0% or less.

The Zn/$MgZn_2$ binary eutectic structure is an important structure from the viewpoint of, for example, obtaining post-coating corrosion resistance, obtaining corrosion resistance when used without being coated, and contributing to suppression of the occurrence of red rust when the coating surface is damaged.

Area Fraction of Massive $MgZn_2$ Phase: 5.0% to 40.0%

In order to obtain suitable post-coating corrosion resistance, the area fraction of the massive $MgZn_2$ phase is 5.0% or more. The area fraction of the massive $MgZn_2$ phase is preferably 10.0% or more.

On the other hand, when the area fraction of a massive $MgZn_2$ phase is more than 40.0%, the area fraction of the $Fe_2Al_5$ phase or the Zn/$MgZn_2$ binary eutectic structure decreases excessively, and it is difficult to obtain suitable post-coating corrosion resistance. Therefore, the area fraction of the massive $MgZn_2$ phase is 40.0% or less.

Area Fraction of Remainder: 10.0% or Less

In order to obtain suitable post-coating corrosion resistance, the total area fraction of structures in the remainder other than the $Fe_2Al_5$ phase, the Zn/$MgZn_2$ binary eutectic structure, and the massive $MgZn_2$ phase is 10.0% or less, preferably 7.5% or less, and more preferably 5.0% or less.

Examples of the structures in the remainder include an Al—Zn dendrite, a Zn/Al/$MgZn_2$ ternary eutectic structure, a massive Zn phase, and a $Mg_2Si$ phase described below. Each of these structures in the remainder will be described below.

Area Fraction of Dendrite (Al—Zn Dendrite) Mainly Formed of Al Primary Crystal Phase and Zn Phase: 5.0% or Less When the plating layer is formed, in the process of cooling the steel sheet from a bath temperature after the hot-dip plating process described below, first, an Al primary phase (α-(Zn,Al) phase crystallized as the primary phase) is crystallized and grows dendritically (hereinafter, also referred to as "Al—Zn dendrite"). Next, by heating the steel sheet in a temperature range of 440° C. to 480° C. to perform the alloying process, most of the Al—Zn dendrite is substantially replaced with another structure, but a part of the Al—Zn dendrite remains even after the alloying process.

The Al—Zn dendrite does not preferably affect post-coating corrosion resistance or LME resistance. Therefore, the area fraction of the Al—Zn dendrite is as low as possible. Therefore, in the plating layer according to the embodiment, the area fraction of the Al—Zn dendrite is 5.0% or less and more preferably 3.0% or less.

"Mainly" represents that about 15% or more of the Al primary crystal phase and the Zn phase are contained in the dendrite by area fraction, and 5% or less of Fe, 3% or less of Mg, and 1% or less of steel component elements (Ni, Mn) may be contained as the remainder other than the Al primary crystal phase and the Zn phase.

Area Fraction of $Zn/Al/MgZn_2$ Ternary Eutectic Structure: 5.0% or Less

The $Zn/Al/MgZn_2$ ternary eutectic structure is a layered structure including a Zn layer, an Al layer, and a $MgZn_2$ layer that is formed of a Zn phase, an Al primary crystal phase, and a $MgZn_2$ phase finally solidified in the outside of the Al primary phase due to a Zn—Al—Mg-based eutectic reaction. The $Zn/Al/MgZn_2$ ternary eutectic structure also has the post-coating corrosion resistance improvement effect, but the improvement effect is lower than that of the $Fe_2Al_5$ phase or the $Zn/MgZn_2$ binary eutectic structure. Therefore, the area fraction of the $Zn/Al/MgZn_2$ ternary eutectic structure is preferably as low as possible. Therefore, in the plating layer according to the embodiment, the area fraction of the $Zn/Al/MgZn_2$ ternary eutectic structure is preferably 5.0% or less and more preferably 3.0% or less.

Area Fraction of Massive Zn Phase: 10.0% or Less

The massive Zn phase is a structure that may be formed when the Mg content in the plating layer is low. When the massive Zn phase is formed, the blister width tends to increase. The area ratio of the massive Zn phase is preferably as low as possible and is preferably 10.0% or less and more preferably 5.0% or less. The massive Zn phase is a phase different from the Zn phase in the $Zn/MgZn_2$ binary eutectic structure. The massive Zn phase has a dendritic shape and may also be observed to be circular on the cross sectional structure.

Other Intermetallic Compound Phase: 10.0% or Less

Other intermetallic compound phases do not preferably affect post-coating corrosion resistance. Therefore, the area fraction of the other intermetallic compound phases is preferably 10.0% or less and more preferably 5.0% or less. Examples of the other intermetallic compound phase include a $Mg_2SiCaZn_{11}$ phase, an $Al_2CaSi_2$ phase, and an $Al_2CaZn_2$ phase.

Unless specified otherwise, "area fraction" in the embodiment refers to an arithmetic mean value when the area ratio of a desired structure in a plating layer cross section is calculated for arbitrarily selected five different samples. This area fraction represents the volume fraction in the plating layer in practice.

<Method of Measuring Area Fraction>

The area fraction of each of the structures in the plating layer is obtained using the following method.

First, a plated steel sheet as a target to be measured is cut into 25 (c)×15 (L) mm, is embedded in a resin, and is polished. Next, a SEM image of a cross section (cross section parallel to the thickness direction) of the plating layer and an element distribution image by EDS are obtained. Regarding the area fractions of the constituent structures of the plating layer, that is, the $Fe_2Al_5$ phase, the massive $MgZn_2$ phase, the $Zn/MgZn_2$ binary eutectic structure, the (Al—Zn) dendrite, the $Zn/Al/MgZn_2$ ternary eutectic structure, the massive Zn phase, the $Mg_2Si$ phase, and the other intermetallic compound phases, one visual field is imaged from each of five samples having different cross sectional EDS mapping images of the plating layers, that is, five visual fields (magnification: 1500-fold) in total are imaged, and the area fraction of each of the structures is measured by image analysis. For example, in the EDS mapping image, regions containing Fe, Zn, Al, Mg, and Si can be displayed by different colors. Therefore, in this mapping image, a phase formed of Al and Fe is determined to be the $Fe_2Al_5$ phase. In addition, in the mapping image, a structure that is formed of a lamellar structure of a Zn phase formed of Zn and a $MgZn_2$ phase containing Zn and Mg is determined to be the $Zn/MgZn_2$ binary eutectic structure. The other phases can be determined using the same method. The area of the visual field may be, for example, 45 μm×60 μm. The area fraction of each of the structures is obtained, for example, as an arithmetic mean value of area fractions of each of the structures measured in the respective visual fields (=(Area of Each of Structures in Any Visual field)/(Area of This Visual field)×100). In Examples described below, the area fraction of each of the structures was measured using this method.

<Characteristics>

The plated steel sheet according to the embodiment has excellent post-coating corrosion resistance by including the steel and the plating layer having the above-described characteristics.

In addition, the plated steel sheet according to the embodiment has excellent LME resistance by including the steel and the plating layer having the above-described characteristics.

[Method of Manufacturing Plated Steel Sheet]

Next, a method of manufacturing the plated steel sheet according to the embodiment will be described.

A method of manufacturing the plated steel sheet according to the embodiment includes: a hot-dip plating process of dipping a base steel sheet in a plating bath containing at least Al, Mg, and Zn by mass % to perform hot-dip plating; an alloying process of heating the hot-dip plated base steel sheet at 440° C. to 480° C. for 1 to 8 seconds; and a cooling process of cooling the plated steel sheet after the alloying process.

<Hot-Dip Plating Process>

In the hot-dip plating process, a base steel sheet is dipped in a plating bath containing at least Al, Mg, and Zn to perform hot-dip plating.

In the hot-dip plating process, a so-called hot-dip plating method of adhering the plating bath to the base steel sheet surface and pulling the base steel sheet from the plating bath to solidify the molten metal adhered to the base steel sheet surface is used.

(Plating Bath)

The composition of the plating bath is not particularly limited as long as it contains at least Al, Mg, and Zn, and raw materials are prepared and dissolved in the plating bath to achieve the composition of the above-described plating layer.

The temperature of the plating bath is preferably in a range of higher than 380° C. and 600° C. or lower and may be in a range of 400° C. to 600° C.

It is preferable that the base steel sheet surface is reduced by heating the base steel sheet in a reducing atmosphere before being dipped in the plating bath. For example, a heat treatment is performed in a mixed atmosphere of nitrogen and hydrogen at 600° C. or higher, desirably 750° C. or higher for 30 seconds or longer. After completion of the reduction treatment, the base steel sheet is dipped in the plating bath after being cooled to the temperature of the plating bath. The dipping time may be, for example, 1 second or longer. When the base steel sheet dipped in the plating bath is pulled, the plating adhesion amount is adjusted by gas wiping. The adhesion amount to the single surface of the base steel sheet is preferably in a range of 10 $g/m^2$ to 300 $g/m^2$ and may be in a range of 20 $g/m^2$ to 250 $g/m^2$.

<Alloying Process>

A method of manufacturing the plated steel sheet according to the embodiment includes the alloying process of heating the hot-dip plated base steel sheet in a temperature range of 440° C. to 480° C. for 1 to 8 seconds after the hot-dip plating process. Through the alloying process, the plating layer having the desired structures (that is, the structures having the above-described area fractions) is formed, and excellent post-coating corrosion resistance can be obtained.

In the alloying process, when the heating temperature is lower than 440° C., the alloying process is slow, which is not preferable. Therefore, the heating temperature in the alloying process is set to be 440° C. or higher.

On the other hand, when the heating temperature in the alloying process is higher than 480° C., alloying progresses excessively within a short period of time, and the alloying process cannot be suitably controlled, which is not preferable. For example, in the alloying process, Fe dispersed in the plating layer reacts with Al prior to Zn such that the $Fe_2Al_5$ phase is formed. However, when alloying progresses excessively, redundant Fe that does not react with Al reacts with Zn in the plating layer such that a large amount of the Fe—Zn phase is formed. Therefore, the heating temperature in the alloying process is set to be 480° C. or lower.

In a case where the heating time in the alloying process is shorter than 1 second, when the hot dip-plated base steel sheet is heated in a temperature range of 440° C. to 480° C., the progress of alloying is insufficient, which is not preferable. Therefore, the heating time in the alloying process is set to be 1 second or longer.

On the other hand, when the heating time in the alloying process is longer than 8 seconds, alloying progresses significantly, which is not preferable. For example, a large amount of the Fe—Zn phase is formed as in the case where the alloying temperature is excessively high. Therefore, the heating time in the alloying process is set to be 8 seconds or shorter.

In the alloying process, a heating method is not particularly limited. For example, a heating method such as induction heating can be used.

The cooling rate after alloying is not particularly limited. For example, the base steel sheet may be cooled from the alloying temperature to room temperature at a cooling rate of about 2° C./sec to 10° C./sec in the general hot-dip plating process.

Through the above-described processes, the plated steel sheet according to the embodiment can be manufactured.

The plated steel sheet according to the embodiment has excellent post-coating corrosion resistance. In addition, the plated steel sheet according to the embodiment has excellent LME resistance.

EXAMPLES

Example 1

<Base Steel Sheet>

As a plated base steel sheet, a cold-rolled steel sheet (0.2% C-1.5% Si-2.6% Mn) having a sheet thickness of 1.6 mm was used.

<Plating Bath>

Plating baths having different chemical compositions depending on Test No. (level) were prepared such that a plating layer having a chemical composition shown in Table 1 was formed on the base steel sheet. The chemical composition of the plating layer was measured using the above-described method.

TABLE 1

| | | Plating Layer Component (mass%) | | | | | | | | Plating Bath | Alloying Process | | |
|---|---|---|---|---|---|---|---|---|---|---|---|---|---|
| | | | | | | | | Impurities | | | | | |
| Classification | No. | Zn | Al | Mg | Fe | Ca | Si | Kind of Element | Total % | temperature (° C.) | Alloying Temperature (° C.) | Alloying Time (sec) | Cooling Rate (° C./sec) |
| Comparative Example | 1 | 88.6 | 4.00 | 3.00 | 4.00 | 0.20 | 0.20 | — | 0 | 440 | 480 | 6 | 10 |
| Comparative Example | 2 | 87.6 | 5.00 | 2.00 | 5.00 | 0.20 | 0.20 | — | 0 | 455 | 480 | 6 | 10 |
| Example | 3 | 87.5 | 5.00 | 2.50 | 5.00 | 0 | 0 | — | 0 | 430 | 440 | 8 | 10 |
| Example | 4 | 84.8 | 5.10 | 5.00 | 5.00 | 0.10 | 0 | — | 0 | 430 | 440 | 8 | 10 |
| Example | 5 | 82.1 | 5.20 | 7.00 | 5.50 | 0.20 | 0 | — | 0 | 450 | 450 | 8 | 10 |
| Example | 6 | 81.3 | 8.10 | 2.50 | 8.10 | 0 | 0 | — | 0 | 450 | 450 | 8 | 10 |
| Example | 7 | 76.2 | 8.30 | 7.00 | 8.30 | 0.20 | 0 | — | 0 | 490 | 480 | 8 | 10 |
| Example | 8 | 77.5 | 9.90 | 2.50 | 9.90 | 0.10 | 0 | Ni:0.15 | 0.15 | 460 | 480 | 8 | 12 |
| Example | 9 | 73.3 | 9.70 | 7.10 | 9.70 | 0.20 | 0 | — | 0 | 490 | 480 | 8 | 10 |
| Example | 10 | 68.6 | 10.20 | 10.20 | 10.20 | 0.70 | 0 | Sb:0.08 | 0.08 | 500 | 480 | 8 | 10 |
| Comparative Example | 11 | 84.8 | 10.20 | 5.00 | 0 | 0 | 0 | — | 0 | 460 | — | — | 10 |
| Comparative Example | 12 | 84.9 | 10.10 | 5.00 | 0 | 0 | 0 | — | 0 | 490 | 300 | 6 | 10 |
| Comparative Example | 13 | 62.7 | 10.80 | 5.00 | 21.50 | 0 | 0 | — | 0 | 490 | 480 | 20 | 10 |
| Example | 14 | 73.0 | 12.00 | 3.00 | 12.00 | 0 | 0 | Ti:0.02 | 0.02 | 460 | 460 | 8 | 10 |
| Example | 15 | 70.9 | 12.00 | 5.00 | 12.00 | 0.10 | 0 | — | 0 | 470 | 470 | 8 | 8 |
| Example | 16 | 68.5 | 12.00 | 7.00 | 12.00 | 0.50 | 0 | — | 0 | 480 | 480 | 8 | 10 |
| Example | 17 | 61.8 | 14.00 | 10.00 | 14.00 | 0.20 | 0 | — | 0 | 500 | 480 | 8 | 2 |
| Example | 18 | 69.0 | 14.00 | 3.00 | 14.00 | 0 | 0 | — | 0 | 460 | 460 | 8 | 10 |
| Example | 19 | 62.8 | 17.00 | 3.00 | 17.00 | 0.20 | 0 | — | 0 | 500 | 480 | 8 | 10 |
| Example | 20 | 60.7 | 17.00 | 5.00 | 17.00 | 0.20 | 0.10 | — | 0 | 500 | 440 | 6 | 10 |
| Example | 21 | 57.9 | 17.00 | 7.50 | 17.00 | 0.30 | 0 | Ni:0.3 | 0.3 | 480 | 480 | 8 | 8 |
| Example | 22 | 55.7 | 17.00 | 10.00 | 17.00 | 0.20 | 0.10 | — | 0 | 510 | 480 | 8 | 10 |
| Comparative Example | 23 | 75.4 | 17.00 | 7.50 | 0 | 0.10 | 0 | — | 0 | 490 | 300 | 6 | 10 |
| Comparative Example | 24 | 75.4 | 17.00 | 7.50 | 0 | 0.10 | 0 | — | 0 | 490 | — | — | 10 |
| Comparative Example | 25 | 58.4 | 17.00 | 7.50 | 17.00 | 0.10 | 0 | — | 0 | 490 | 480 | 20 | 10 |
| Comparative Example | 26 | 72.3 | 17.00 | 7.50 | 0 | 0.10 | 3.10 | — | 0 | 490 | 480 | 6 | 10 |
| Comparative Example | 27 | 56.0 | 17.00 | 7.50 | 17.00 | 2.50 | 0 | — | 0 | 490 | 480 | 6 | 10 |
| Comparative Example | 28 | 51.9 | 17.00 | 14.00 | 17.00 | 0.10 | 0 | — | 0 | 490 | 480 | 6 | 10 |
| Example | 29 | 55.0 | 21.00 | 3.00 | 21.00 | 0 | 0 | — | 0 | 500 | 480 | 8 | 10 |
| Example | 30 | 52.8 | 21.00 | 5.00 | 21.00 | 0.10 | 0.10 | — | 0 | 500 | 480 | 8 | 10 |
| Example | 31 | 50.3 | 21.00 | 7.50 | 21.00 | 0.20 | 0 | — | 0 | 500 | 480 | 8 | 10 |

TABLE 1-continued

| | | Plating Layer Component (mass%) | | | | | | | | | Alloying Process | | |
|---|---|---|---|---|---|---|---|---|---|---|---|---|---|
| | | | | | | | | Impurities | | Plating Bath | Alloying | Alloying | Cooling |
| Classification | No. | Zn | Al | Mg | Fe | Ca | Si | Kind of Element | Total % | temperature (° C.) | Temperature (° C.) | Time (sec) | Rate (° C./sec) |
| Example | 32 | 39.0 | 25.00 | 10.00 | 25.00 | 1.00 | 0 | — | 0 | 530 | 480 | 8 | 2 |
| Example | 33 | 42.0 | 25.00 | 7.50 | 25.00 | 0.50 | 0 | Pb:0.01 | 0.01 | 540 | 480 | 8 | 10 |
| Example | 34 | 39.0 | 25.00 | 10.00 | 25.00 | 1.00 | 0 | — | 0 | 520 | 480 | 8 | 8 |
| Example | 35 | 26.9 | 30.00 | 13.00 | 30.00 | 0.10 | 0 | — | 0 | 540 | 480 | 8 | 10 |
| Example | 36 | 37.0 | 30.00 | 3.00 | 30.00 | 0 | 0 | — | 0 | 550 | 480 | 8 | 10 |
| Example | 37 | 27.4 | 35.00 | 2.50 | 35.00 | 0.10 | 0 | Sn:0.02 | 0.02 | 550 | 480 | 8 | 2 |
| Example | 38 | 23.0 | 35.00 | 7.00 | 35.00 | 0 | 0 | — | 0 | 550 | 480 | 8 | 8 |
| Example | 39 | 18.8 | 35.00 | 10.00 | 35.00 | 0.20 | 1.00 | — | 0 | 550 | 480 | 8 | 10 |
| Comparative Example | 40 | 46.5 | 35.00 | 8.00 | 8.00 | 0.20 | 2.30 | — | 0 | 510 | 480 | 6 | 10 |
| Comparative Example | 41 | 42.8 | 35.00 | 14.00 | 8.00 | 0.20 | 0 | — | 0 | 510 | 480 | 6 | 10 |
| Comparative Example | 42 | 20.8 | 36.00 | 7.00 | 36.00 | 0.20 | 0 | — | 0 | 580 | 480 | 6 | 10 |
| Comparative Example | 43 | 43.2 | 7.00 | 4.00 | 26.00 | 0.10 | 0 | — | 0 | 480 | 650 | 15 | 10 |
| Comparative Example | 44 | Commercially Available Alloyed Hot-Dip Plated Steel Sheet | | | | | | | | | | | |

<Hot-Dip Plating Process>

The base steel sheet was cut into 100 mm×200 mm and subsequently was plated using a batch type hot-dip plating test apparatus. The sheet temperature was measured using a thermocouple spot-welded to a central part of the base steel sheet.

Before dipping in the plating bath, in a furnace having an oxygen concentration of 20 ppm or lower, the base steel sheet surface was heated and reduced at 860° C. in an atmosphere of $N_2$-5% $H_2$ gas and a dew point of 0° C. Next, the base steel sheet was air-cooled with $N_2$ gas such that the dipped sheet temperature reached the bath temperature+20° C., and was dipped in the plating bath having a bath temperature shown in Table 1 for about 3 seconds.

After dipping in the plating bath, the base steel sheet was pulled at a pulling rate of 100 mm/sec to 500 mm/sec. During pulling, the plating adhesion amount was controlled to be 15 g/m$^2$ to 150 g/m$^2$ by $N_2$ wiping gas.

<Alloying Process>

After controlling the plating adhesion amount with the wiping gas, the alloying process was performed on the plated steel sheet under conditions of an alloying temperature and an alloying time shown in Table 1. In the alloying process, an induction heating device was used.

The plated steel sheet was cooled from the plating bath temperature to room temperature by being cooled under conditions shown in Table 1 after the alloying heat treatment.

<Structure Observation>

In order to investigate the structure configuration of the plating layer, the prepared sample was cut into 25 (c)×15 (L) mm, was embedded in a resin, and was polished. Next, a cross sectional SEM image of the plating layer and an element distribution image by EDS were obtained. Regarding the area fractions of the constituent structures of the plating layer, that is, the $Fe_2Al_5$ phase, the massive $MgZn_2$ phase, the Zn/$MgZn_2$ binary eutectic structure, the (Al—Zn) dendrite, and the other metallic compounds, one visual field was imaged from each of five samples having different cross sectional EDS mapping images of the plating layers, that is, five visual fields (magnification: 1500-fold) in total were imaged, and the area fraction of each of the structures was measured by image analysis. The area of each of the visual fields was 45 μm×60 μm. The specific measurement method is as described above.

The area fraction of each of the structures in each of Examples and Comparative Examples is shown in Table 2.

<Post-Coating Corrosion Resistance>

In each of Examples and Comparative Examples, the post-coating corrosion resistance was evaluated using the following method.

The plated steel sheet according to each of Examples and Comparative Examples manufactured using the above-described method was cut into a size of 50 mm×100 mm, and a zinc phosphating process (SD5350 system, manufactured by Nippon Paint Industrial Coatings Co., Ltd.) was performed thereon.

By baking the plated steel sheet on which the zinc phosphating process was performed at baking temperature: 150° C. for baking time: 20 minutes, an electrodeposition film having a thickness of 20 μm was formed (PN110 POWERNICS GREY, manufactured by Nippon Paint Industrial Coatings Co., Ltd.).

Crosscut damages (40×√2, two damages) reaching base metal were formed on the plated steel sheet on which the electrodeposition film was formed. The plated steel sheet on which the crosscut damages were formed was provided for a combined cyclic corrosion test according to JASO (M609-91). The corrosion test was performed in 120 cycles, the maximum blister width was measured at eight positions around the crosscuts, and the average value thereof was obtained to evaluate post-coating corrosion resistance.

When the number of cycles of JASO (M609-91) was 180, a case where the blister width from the crosscut damage was less than 0.3 mm was evaluated as "AA", a case where the blister width from the crosscut damage was 0.3 mm or more and less than 0.5 mm was evaluated as "A", a case where the blister width from the crosscut damage was 0.5 mm or more and less than 1.5 mm was evaluated as "B", a case where the blister width from the crosscut damage was 1.5 mm or more and less than 3.0 mm was evaluated as "C", and a case where the blister width from the crosscut damage was 3.0 mm or more was evaluated as "D". "A" or higher was an acceptable level.

<Red Rust>

In each of Examples and Comparative Examples, the red rust was evaluated using the following method. That is, in the test of JASO (M609-91), whether or not red rust occurred in the crosscut damages was determined by visual inspection. A case where red rust did not occur after 180 cycles was evaluated as "A", a case where red rust occurred in the crosscut damages after less than 180 cycles to 120 cycles was evaluated as "B", and a case where red rust occurred in the crosscut damages after less than 120 cycles was evaluated as "C". "A" was an acceptable level.

At a level (Comparative Examples 11 and 24) where the alloying process was not performed and at a level (Comparative Examples 12 and 23) where the alloying temperature was excessively low, a sufficient amount of the $Fe_2Al_5$ phase was not able to be formed, the structure of the remainder was excessively formed, and the performance was poor. At a level (Comparative Examples 13 and 25) where the alloying time was excessively long, the $Fe_2Al_5$ phase and the eutectic structure of Zn and $MgZn_2$ or the structure of the remainder was excessively formed, and the performance was poor. At a level (comparative Example 43) where the alloying temperature was excessively high and the alloying time was excessively long, the eutectic structure of Zn and $MgZn_2$ was not able to be sufficiently formed, the Fe—Zn phase was excessively formed (the Fe—Zn phase was counted as the other intermetallic compound phase), and the performance was poor. In particular, red rust was likely to occur as compared to the other Comparative Examples.

TABLE 2

| | | Area Fraction of Each of Structures in Plating Layer | | | | | | | | | Post-Coating Corrosion Resistance | |
|---|---|---|---|---|---|---|---|---|---|---|---|---|
| Classification | No. | $Fe_2Al_5$ Phase | $Zn/MgZn_2$ Binary Eutectic Structure | Massive $MgZn_2$ Phase | (A) Al-Zn Dendrite | (B) Zn/Al/MgZn, Ternary Eutectic Structure | (C) Massive Zn Phase | (D) $Mg_2Si$ Phase | (E) Other Intermetallic Compound Phase | Sum of (A) to (E) | Red Rust | Coating Blistering |
| Comparative Example | 1 | 4.0 | 88.5 | 7.5 | 0.0 | 0.0 | 0.0 | 0.0 | 0.0 | 0.0 | A | B |
| Comparative Example | 0 | 10.0 | 65.8 | 2.1 | 0.0 | 0.0 | 22.1 | 0.0 | 0.0 | 22.1 | A | B |
| Example | 3 | 12.1 | 80.0 | 7.9 | 0.0 | 0.0 | 0.0 | 0.0 | 0.0 | 0.0 | A | A |
| Example | 4 | 10.0 | 69.0 | 21.0 | 0.0 | 0.0 | 0.0 | 0.0 | 0.0 | 0.0 | A | A |
| Example | 5 | 11.0 | 67.0 | 22.0 | 0.0 | 0.0 | 0.0 | 0.0 | 0.0 | 0.0 | A | A |
| Example | 6 | 15.0 | 80.0 | 5.0 | 0.0 | 0.0 | 0.0 | 0.0 | 0.0 | 0.0 | A | A |
| Example | 7 | 13.0 | 66.0 | 21.0 | 0.0 | 0.0 | 0.0 | 0.0 | 0.0 | 0.0 | A | A |
| Example | 8 | 14.9 | 80.0 | 5.0 | 0.0 | 0.0 | 0.0 | 0.0 | 0.1 | 0.1 | A | A |
| Example | 9 | 14.7 | 54.3 | 31.0 | 0.0 | 0.0 | 0.0 | 0.0 | 0.0 | 0.0 | A | A |
| Example | 10 | 18.0 | 47.0 | 35.0 | 0.0 | 0.0 | 0.0 | 0.0 | 0.0 | 0.0 | A | A |
| Comparative Example | 11 | 0.0 | 44.0 | 20.0 | 36.0 | 0.0 | 0.0 | 0.0 | 0.0 | 36.0 | B | C |
| Comparative Example | 12 | 0.0 | 39.0 | 22.0 | 39.0 | 0.0 | 0.0 | 0.0 | 0.0 | 39.0 | B | C |
| Comparative Example | 13 | 18.9 | 49.9 | 21.1 | 0.0 | 0.0 | 0.0 | 0.0 | 10.1 | 10.1 | B | B |
| Example | 14 | 19.7 | 63.9 | 16.0 | 0.0 | 0.0 | 0.0 | 0.0 | 0.4 | 0.4 | A | A |
| Example | 15 | 21.0 | 57.9 | 21.1 | 0.0 | 0.0 | 0.0 | 0.0 | 0.0 | 0.0 | A | AA |
| Example | 16 | 22.0 | 53.2 | 24.8 | 0.0 | 0.0 | 0.0 | 0.0 | 0.0 | 0.0 | A | AA |
| Example | 17 | 28.1 | 41.1 | 30.8 | 0.0 | 0.0 | 0.0 | 0.0 | 0.0 | 0.0 | A | AA |
| Example | 18 | 29.8 | 58.1 | 12.1 | 0.0 | 0.0 | 0.0 | 0.0 | 0.0 | 0.0 | A | A |
| Example | 19 | 38.1 | 47.3 | 14.6 | 0.0 | 0.0 | 0.0 | 0.0 | 0.0 | 0.0 | A | A |
| Example | 20 | 32.5 | 33.3 | 28.7 | 5.0 | 0.0 | 0.5 | 0.5 | 0.0 | 6.0 | A | AA |
| Example | 21 | 40.5 | 38.0 | 21.2 | 0.0 | 0.0 | 0.0 | 0.0 | 0.3 | 0.3 | A | AA |
| Example | 22 | 40.0 | 28.9 | 30.0 | 0.0 | 0.0 | 1.1 | 1.1 | 0.0 | 2.2 | A | AA |
| Comparative Example | 23 | 0.0 | 0.0 | 30.0 | 36.0 | 34.0 | 0.0 | 0.0 | 0.0 | 70.0 | B | C |
| Comparative Example | 24 | 0.0 | 0.0 | 29.8 | 35.5 | 34.7 | 0.0 | 0.0 | 0.0 | 70.2 | B | C |
| Comparative Example | 25 | 70.0 | 8.9 | 21.1 | 0.0 | 0.0 | 0.0 | 0.0 | 0.0 | 0.0 | B | B |
| Comparative Example | 26 | 10.1 | 50.8 | 29.0 | 0.0 | 0.0 | 0.0 | 10.1 | 0.0 | 10.1 | A | B |
| Comparative Example | 27 | 10.0 | 51.3 | 28.5 | 0.0 | 0.0 | 0.0 | 0.0 | 10.2 | 10.2 | A | B |
| Comparative Example | 28 | 4.1 | 6.2 | 11.0 | 28.1 | 50.6 | 0.0 | 0.0 | 0.0 | 78.7 | B | C |
| Example | 29 | 44.0 | 45.2 | 10.8 | 0.0 | 0.0 | 0.0 | 0.0 | 0.0 | 0.0 | A | A |
| Example | 30 | 44.0 | 40.9 | 14.5 | 0.0 | 0.0 | 0.6 | 0.6 | 0.0 | 1.2 | A | AA |
| Example | 31 | 45.1 | 29.0 | 25.9 | 0.0 | 0.0 | 0.0 | 0.0 | 0.0 | 0.0 | A | AA |
| Example | 32 | 51.6 | 18.4 | 30.0 | 0.0 | 0.0 | 0.0 | 0.0 | 0.0 | 0.0 | A | AA |
| Example | 33 | 52.0 | 26.5 | 21.4 | 0.0 | 0.0 | 0.0 | 0.0 | 0.1 | 0.1 | A | AA |
| Example | 34 | 53.1 | 13.6 | 33.3 | 0.0 | 0.0 | 0.0 | 0.0 | 0.0 | 0.0 | A | AA |
| Example | 35 | 51.6 | 13.3 | 35.1 | 0.0 | 0.0 | 0.0 | 0.0 | 0.0 | 0.0 | A | AA |
| Example | 36 | 51.4 | 38.6 | 10.0 | 0.0 | 0.0 | 0.0 | 0.0 | 0.0 | 0.0 | A | A |
| Example | 37 | 56.8 | 35.0 | 8.0 | 0.0 | 0.0 | 0.0 | 0.0 | 0.2 | 0.2 | A | AA |
| Example | 38 | 57.8 | 20.9 | 21.3 | 0.0 | 0.0 | 0.0 | 0.0 | 0.0 | 0.0 | A | AA |
| Example | 39 | 58.3 | 10.0 | 30.1 | 0.0 | 0.0 | 0.0 | 1.6 | 0.0 | 1.6 | A | AA |
| Comparative Example | 40 | 60.2 | 4.1 | 25.4 | 0.0 | 0.0 | 0.0 | 10.3 | 0.0 | 10.3 | A | B |
| Comparative Example | 41 | 58.2 | 1.6 | 40.2 | 0.0 | 0.0 | 0.0 | 0.0 | 0.0 | 0.0 | A | B |
| Comparative Example | 42 | 72.5 | 3 | 24.5 | 0.0 | 0.0 | 0.0 | 0.0 | 0.0 | 0.0 | A | B |
| Comparative Example | 43 | 11 | 9 | 35 | 0.0 | 0.0 | 0.0 | 0.0 | 45.0 | 45.0 | C | B |
| Comparative Example | 44 | Commercially Available Alloyed Hot Dip Plated Steel Sheet | | | | | | | | | C | B |

It was found that, in each of Examples prepared with the predetermined plating bath composition under the appropriate alloying process conditions, the predetermined structures were able to be obtained such that suitable post-coating corrosion resistance was obtained and the occurrence of red rust was able to be suppressed.

On the other hand, at a level (Comparative Example 1) where the amounts of Al and Fe were insufficient, a sufficient amount of the $Fe_2Al_5$ phase was not able to be formed, and the performance was poor. At a level (Comparative Example 2) where the amount of Mg was insufficient, a sufficient amount of the massive $MgZn_2$ phase was not able to be formed, the structure of the remainder was excessively formed (the sum of the area fractions ((A) to (E)) exceed 10.0%), and the performance was poor.

In addition, at a level (Comparative Examples 26, 27, and 40) where an excess amount of Ca or Si was contained, 10.0% or more of the intermetallic compound phases such as $Mg_2Si$ or $CaZn_{11}$ deteriorating corrosion resistance were formed in the plating layer. Further, in Comparative Example 40, an excess amount of the $Fe_2Al_5$ phase was formed, and the eutectic structure of Zn and $MgZn_2$ was not sufficiently formed. Therefore, at these levels, the post-coating corrosion resistance was poor.

At a level (Comparative Example 28) where an excess amount of Mg was contained, sufficient amounts of the $Fe_2Al_5$ phase and the eutectic structure of Zn and $MgZn_2$ were not able to be formed, the structure of the remainder was excessively formed, and the performance was poor. Comparative Example 41 was also a level where an excess amount of Mg was contained, but a sufficient amount of the $Fe_2Al_5$ phase was formed. The reason for this is presumed to be that the Al content was high but in the range of the embodiment. However, the eutectic structure of Zn and $MgZn_2$ and the massive $MgZn_2$ phase were not sufficiently formed, and the performance was poor.

At a level (Comparative Example 42) where excess amounts of Al and Fe were contained, an excess amount of the $Fe_2Al_5$ phase was formed, the eutectic structure of Zn and $MgZn_2$ and the massive $MgZn_2$ phase were not sufficiently formed, and the performance was poor. Comparative Example 44 was a commercially available alloyed hot-dip plated steel sheet, and the performance was poorer than Examples.

Example 2

In Example 2, LME resistance was investigated for Examples and Comparative Examples used in Example 1. That is, the components, the structures, and the manufacturing conditions of the plated steel sheets used in Example 2 are shown in Table 1.

<LME Resistance>

Some of the plated steel sheets according to Examples and Comparative Examples used in Example 1 were cut into a size of 200 mm×20 mm and were provided for a hot tensile test where a tension rate was 5 mm/min and a chuck-to-chuck distance was 112.5 mm, and a stress-strain curve at 800° C. was measured. The strain amount was measured until the maximum stress was reached in the obtained stress-strain curve.

A case where the strain amount was 80% or more with respect to a steel sheet sample on which plating was not performed was evaluated as "AA", a case where the strain amount was 60% or less with respect to a steel sheet sample on which plating was not performed was evaluated as "A", a case where the strain amount was 40% or more and less than 60% with respect to a steel sheet sample on which plating was not performed was evaluated as "B", and a case where the strain amount was less than 40% with respect to a steel sheet sample on which plating was not performed was evaluated as "C". "A" or higher was an acceptable level.

The evaluation results of LME resistance of Examples and Comparative Examples are shown in Table 3. The area fraction of each of the structures is shown in Table 2 and thus is not shown in Table 3.

TABLE 3

| Classification | No. | LME Resistance |
|---|---|---|
| Comparative Example | 1 | B |
| Comparative Example | 2 | B |
| Example | 3 | A |
| Example | 4 | A |
| Example | 5 | A |
| Example | 6 | A |
| Example | 7 | A |
| Example | 8 | A |
| Example | 9 | A |
| Example | 10 | A |
| Comparative Example | 11 | B |
| Comparative Example | 12 | B |
| Comparative Example | 13 | B |
| Example | 14 | A |
| Example | 15 | A |
| Example | 16 | A |
| Example | 17 | A |
| Example | 18 | A |
| Example | 19 | AA |
| Example | 20 | AA |
| Example | 21 | AA |
| Example | 22 | AA |
| Comparative Example | 23 | B |
| Comparative Example | 24 | B |
| Comparative Example | 26 | B |
| Comparative Example | 27 | B |
| Comparative Example | 28 | B |
| Example | 29 | AA |
| Example | 30 | AA |
| Example | 31 | AA |
| Example | 32 | AA |
| Example | 33 | AA |
| Example | 34 | AA |
| Example | 35 | AA |
| Example | 36 | AA |
| Example | 37 | AA |
| Example | 38 | AA |
| Example | 39 | AA |
| Comparative Example | 40 | B |
| Comparative Example | 41 | B |
| Comparative Example | 42 | B |
| Comparative Example | 43 | B |

As shown in Table 3, in each of Examples, LME resistance was suitable. On the other hand, in Comparative Examples, LME resistance was poorer than Examples.

BRIEF DESCRIPTION OF THE REFERENCE SYMBOLS

20: plated steel sheet according to embodiment
5: steel
10: hot-dip Zn—Al—Mg-based plating layer
11: $Fe_2Al_5$ phase
12: massive $MgZn_2$ phase
13: Zn/$MgZn_2$ binary eutectic structure
100: plated steel sheet in the related art
130: hot-dip Zn—Al—Mg-based plating layer
131: Zn/Al/$MgZn_2$ ternary eutectic structure
133: (Al—Zn) dendrite

What is claimed is:

1. A plated steel sheet comprising:
a steel; and
a plating layer that is provided on a surface of the steel, wherein the plating layer includes, by mass %,
Al: 5.00% to 35.00%,
Mg: 2.50% to 13.00%,
Fe: 5.00% to 35.00%,
Si: 0% to 2.00%,
Ca: 0% to 2.00%, and
a remainder consisting of Zn and impurities, and
in a cross section of the plating layer, an area fraction of a $Fe_2Al_5$ phase is 5.0% to 60.0%, an area fraction of an eutectic structure of Zn and $MgZn_2$ is 10.0% to 80.0%, an area fraction of a massive $MgZn_2$ phase is 5.0% to 40.0%, and an area fraction of a remainder is 10.0% or less.

2. The plated steel sheet according to claim 1, wherein the plating layer includes, by mass %, Al: 10.00% to 30.00%.

3. The plated steel sheet according to claim 1, wherein the plating layer includes, by mass %, Mg: 3.00% to 11.00%.

4. The plated steel sheet according to claim 1, wherein the plating layer includes, by mass %, Mg: 4.00% or more.

5. The plated steel sheet according to claim 1, wherein the plating layer includes, by mass %, Ca: 0.03% to 1.0%.

6. The plated steel sheet according to claim 1, wherein in the cross section of the plating layer, an area fraction of a $Fe_2Al_5$ phase is 20.0% to 60.0%.

7. The plated steel sheet according to claim 1, wherein in the cross section of the plating layer, an area fraction of an Al—Zn dendrite mainly formed of an Al primary crystal phase and a Zn phase is 5.0% or less.

8. The plated steel sheet according to claim 1, wherein in the cross section of the plating layer, an area fraction of a Zn/Al/$MgZn_2$ ternary eutectic structure is 5.0% or less.

9. The plated steel sheet according to claim 1, wherein in the cross section of the plating layer, an area fraction of a massive Zn phase is 5.0% or less.

10. The plated steel sheet according to claim 1, wherein in the cross section of the plating layer, an area fraction of a $Mg_2Si$ phase is 5.0% or less.

11. The plated steel sheet according to claim 2, wherein the plating layer includes, by mass %, Mg: 3.00% to 11.00%.

12. The plated steel sheet according to claim 2, wherein the plating layer includes, by mass %, Mg: 4.00% or more.

13. The plated steel sheet according to claim 3, wherein the plating layer includes, by mass %, Mg: 4.00% or more.

14. The plated steel sheet according to claim 2, wherein the plating layer includes, by mass %, Ca: 0.03% to 1.0%.

15. The plated steel sheet according to claim 3, wherein the plating layer includes, by mass %, Ca: 0.03% to 1.0%.

16. The plated steel sheet according to claim 4, wherein the plating layer includes, by mass %, Ca: 0.03% to 1.0%.

17. The plated steel sheet according to claim 2, wherein in the cross section of the plating layer, an area fraction of a $Fe_2Al_5$ phase is 20.0% to 60.0%.

18. The plated steel sheet according to claim 3, wherein in the cross section of the plating layer, an area fraction of a $Fe_2Al_5$ phase is 20.0% to 60.0%.

19. The plated steel sheet according to claim 4, wherein in the cross section of the plating layer, an area fraction of a $Fe_2Al_5$ phase is 20.0% to 60.0%.

20. A plated steel sheet comprising:

a steel; and a plating layer that is provided on a surface of the steel, wherein the plating layer includes, by mass %, Al: 5.00% to 35.00%, Mg: 2.50% to 13.00%, Fe: 5.00% to 35.00%, Si: 0% to 2.00%, Ca: 0% to 2.00%, and a remainder comprising Zn and impurities, and in a cross section of the plating layer, an area fraction of a $Fe_2Al_5$ phase is 5.0% to 60.0%, an area fraction of an eutectic structure of Zn and $MgZn_2$ is 10.0% to 80.0%, an area fraction of a massive $MgZn_2$ phase is 5.0% to 40.0%, and an area fraction of a remainder is 10.0% or less.

* * * * *